US008571852B2

(12) United States Patent
Bruhn

(10) Patent No.: US 8,571,852 B2
(45) Date of Patent: Oct. 29, 2013

(54) POSTFILTER FOR LAYERED CODECS

(75) Inventor: Stefan Bruhn, Sollentuna (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 1092 days.

(21) Appl. No.: 12/529,652

(22) PCT Filed: Dec. 14, 2007

(86) PCT No.: PCT/SE2007/050999

§ 371 (c)(1),
(2), (4) Date: Sep. 2, 2009

(87) PCT Pub. No.: WO2008/108701

PCT Pub. Date: Sep. 12, 2008

(65) Prior Publication Data

US 2010/0063801 A1 Mar. 11, 2010

Related U.S. Application Data

(60) Provisional application No. 60/892,638, filed on Mar. 2, 2007.

(51) Int. Cl.
*G10L 19/00* (2013.01)

(52) U.S. Cl.
USPC ..... 704/201; 704/262; 704/229; 704/228; 704/224; 704/223; 704/221; 704/219; 704/216; 704/211; 704/208; 704/205; 704/203; 382/248; 379/406.06; 375/240.11

(58) Field of Classification Search
USPC ..... 704/262, 229, 228, 224, 223, 221, 219, 704/216, 211, 208, 205, 203; 382/248; 379/406.06; 375/240.11
See application file for complete search history.

(56) References Cited

U.S. PATENT DOCUMENTS

| | | | | | |
|---|---|---|---|---|---|
| 4,796,296 | A | * | 1/1989 | Amada et al. | 379/406.06 |
| 5,293,449 | A | * | 3/1994 | Tzeng | 704/223 |
| 5,694,519 | A | * | 12/1997 | Chen et al. | 704/228 |
| 5,774,835 | A | * | 6/1998 | Ozawa | 704/205 |
| 5,798,795 | A | * | 8/1998 | Glenn et al. | 375/240.11 |
| 5,867,814 | A | * | 2/1999 | Yong | 704/216 |
| 5,899,967 | A | * | 5/1999 | Nagasaki | 704/208 |
| 6,052,660 | A | * | 4/2000 | Sano | 704/221 |
| 6,167,375 | A | * | 12/2000 | Miseki et al. | 704/229 |
| 6,526,378 | B1 | * | 2/2003 | Tasaki | 704/224 |

(Continued)

FOREIGN PATENT DOCUMENTS

WO WO 2007010158 A2 1/2007

*Primary Examiner* — Michael Colucci

(57) ABSTRACT

A scalable decoder device (50) for signals representing audio comprises a primary decoder (21) connected to an input (40). The primary decoder (21) is arranged to provide a primary decoded signal (23) based on received parameters (4). A primary postfilter (31) is connected to the primary decoder (23) to provide a primary postfiltered signal (32). A secondary enhancement decoder (45) is connected to the input (40) and arranged to provide a secondary decoded enhancement signal (44). The device further comprises a combiner arrangement (55), arranged for combining the primary postfiltered signal (32) and a signal (53) based on the secondary decoded enhancement signal (44) into an output signal (6) to be provided at an output (6). The combining is made with an adaptable strength relation between contributions from the two signals. A method for decoding coded signals representing audio operates in analogy with the scalable decoder device (50).

36 Claims, 12 Drawing Sheets

(56) References Cited

U.S. PATENT DOCUMENTS

| | | | | |
|---|---|---|---|---|
| 6,587,509 | B1 * | 7/2003 | Suzuki et al. | 375/240.29 |
| 7,305,139 | B2 * | 12/2007 | Srinivasan et al. | 382/248 |
| 7,433,815 | B2 * | 10/2008 | Jabri et al. | 704/203 |
| 7,707,034 | B2 * | 4/2010 | Sun et al. | 704/262 |
| 7,873,511 | B2 * | 1/2011 | Herre et al. | 704/205 |
| 2002/0173951 | A1 * | 11/2002 | Ehara | 704/219 |
| 2005/0091046 | A1 * | 4/2005 | Thyssen et al. | 704/211 |
| 2005/0091051 | A1 | 4/2005 | Moriya et al. | |
| 2006/0271354 | A1 * | 11/2006 | Sun et al. | 704/205 |
| 2007/0223577 | A1 | 9/2007 | Ehara et al. | |
| 2007/0271102 | A1 | 11/2007 | Morii | |
| 2008/0004869 | A1 * | 1/2008 | Herre et al. | 704/211 |
| 2009/0216527 | A1 | 8/2009 | Oshikiri | |
| 2009/0313009 | A1 * | 12/2009 | Kovesi et al. | 704/203 |

* cited by examiner

POSTFILTER FOR LAYERED CODECS

This application claims the benefit of U.S. Provisional Application No. 60/892,638, filed Mar. 2, 2007, the disclosure of which is fully incorporated herein by reference.

TECHNICAL FIELD

The present invention relates in general to audio codecs, and in particular to reducing the coding noise that is inserted into the speech during encoding.

BACKGROUND

In general, audio coding, and specifically speech coding, performs a mapping from an analog input audio or speech signal to a digital representation in a coding domain and back to analog output audio or speech signal. The digital representation goes along with the quantization or discretization of values or parameters representing the audio or speech. The quantization or discretization can be regarded as perturbing the true values or parameters with coding noise. The art of audio or speech coding is about doing the encoding such that the effect of the coding noise in the decoded speech at a given bit rate is as small as possible. However, the given bit rate at which the speech is encoded defines a theoretical limit down to which the coding noise can be reduced at the best. The goal is at least to make the coding noise as inaudible as possible.

Scalable or embedded coding is a coding paradigm in which the coding is done in layers. The base or core layer encodes the signal at a low bit rate, while additional layers, each on top of each other, provide some enhancement relative to the coding which is achieved with all layers from the core up to the respective previous layer. Each layer adds some additional bit rate. The generated bit stream is embedded, meaning that the bit stream of lower-layer encoding is embedded into bit streams of higher layers. This property makes it possible anywhere in the transmission or in the receiver to drop the bits belonging to higher layers. Such stripped bit stream can still be decoded up to the layer which bits are retained.

A suitable view on the coding noise is to assume it to be some additive white or colored noise. There is a class of enhancement methods which after decoding of the audio or speech signal at the decoder modify the coding noise such that it becomes less audible, which hence results in that the audio or speech quality is improved. Such technology is usually called 'postfiltering', which means that the enhanced audio or speech signal is derived in some post processing after the actual decoder. There are many publications on speech enhancement with postfilters. Some of the most fundamental papers are [1]-[4].

Relevant in the context of the invention are pitch or fine-structure postfilters. Their basic working principle is to remove at least parts of the (coding) noise which floods the spectral valleys in between harmonics of voiced speech. This is in general achieved by a weighted superposition of the decoded speech signal with time-shifted versions of it, where the time-shift corresponds to the pitch lag or period of the speech. Preferably, also time-shifted versions into the future speech signal samples are included.

One problem with pitch postfilters which evaluate future speech signals is that they require access to one future pitch period of the decoded audio or speech signal. Making this future signal available for the postfilter is generally possible by buffering the decoded audio or speech signal. In conversational applications of the audio or speech codec this is, however, undesirable since it increases the algorithmic delay of the codec and hence would affect the communication quality and particularly the inter-activity.

SUMMARY

An object of the present invention is to provide improved audio or speech quality from scalable decoder devices. A further object of the present invention is to provide efficient postfilter arrangements for use with scalable decoder devices, which do not contribute considerably to any additional delay of the audio or speech signal.

The above objects are achieved by devices and methods according to the enclosed patent claims. In general words, according to a first aspect, a decoder device for signals representing audio or speech, preferably a scalable decoder device, comprises an input for parameters of coded signals and a primary decoder connected to the input. The primary decoder is arranged to provide a primary decoded signal based on the parameters. A primary postfilter is connected to the output of the primary decoder and arranged to provide a primary postfiltered signal. A secondary decoder is connected to the input and arranged to provide a secondary decoded signal based on the parameters. The scalable decoded device further comprises a combiner arrangement, arranged for combining the primary postfiltered signal and a signal based on the secondary decoded enhancement signal into an output signal. The combining is made in such a manner that the output signal is a weighted combination of the primary postfiltered signal and the signal based on the secondary decoded signal. The scalable decoded device also comprises an output for the output signal, connected to the combiner arrangement.

According to a second aspect, a method of decoding coded signals representing audio or speech comprises receiving of parameters of a coded signal and primary decoding of the parameters into a primary decoded signal. The primary decoded signal is primary postfiltered into a primary postfiltered signal. The parameters are also secondary decoded into a secondary decoded signal. The method further comprises combining of the primary postfiltered audio signal and a signal based on the secondary decoded signal into an output signal. The output signal is a weighted combination of the primary postfiltered signal and the signal based on the secondary decoded signal. The output signal is then outputted.

With the invention it is possible to improve the reconstruction signal quality of a scalable speech and audio codec without adding any further delay.

BRIEF DESCRIPTION OF THE DRAWINGS

The invention, together with further objects and advantages thereof, may best be understood by making reference to the following description taken together with the accompanying drawings, in which.

DETAILED DESCRIPTION

Throughout the present disclosures, equal or directly corresponding features in different figures and embodiments will be denoted by the same reference numbers.

In order to fully understand the detailed description, some terms may have to be defined more explicitly in order to avoid confusion. In the present disclosure, the term "parameter" is used as a generic term, which stands for any kind of representation of the signal, including bits or a bitstream.

The different means and signals related to a secondary decoder are also defined as follows. A "secondary decoder" is a generic expression for different types of secondary deciding arrangements. It comprises e.g. a secondary enhancement decoder or a secondary reconstruction decoder. A "secondary enhancement decoder" relates to scalable coding and is hence a subset of secondary decoders. Such "secondary enhancement decoder" provides some kind of enhancement signal, to be added e.g. to a primary decoded signal. A "secondary reconstruction decoder" means a secondary decoder which delivers an output in the reconstruction signal domain, i.e. a reconstructed speech or audio signal. It may either mean that the secondary decoder generates such output or, in case of scalable codecs, that it is derived based on the primary decoder output and the output of a secondary enhancement decoder. Signals outputted from such secondary decoders are denoted analogously.

Figure 1:
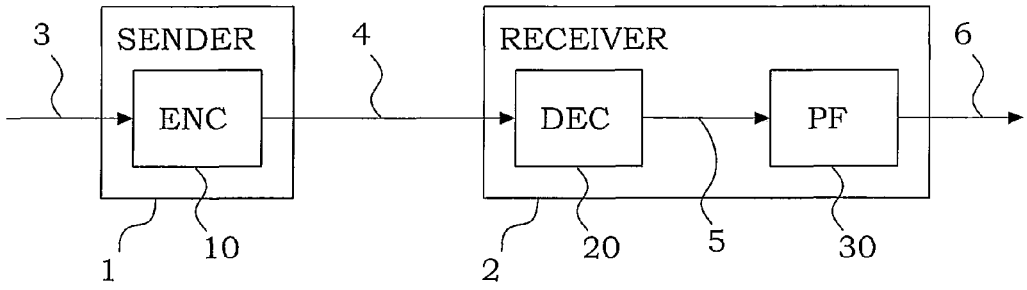
FIG. 1 is an illustration of a basic structure of an audio or speech codec with a postfilter.

In order to understand the advantages achieved by the present invention, the detailed description will begin with a short review of postfiltering in general. FIG. 1 illustrates a basic structure of an audio or speech codec with a postfilter. A sender unit 1 comprises an encoder 10 that encodes incoming audio or speech signal 3 into a stream of parameters 4. The parameters 4 are typically encoded and transferred to a receiver unit 2. The receiver unit 2 comprises a decoder 20, which receives the parameters 4 representing the original audio or speech signal 3, and decodes these parameters 4 into a decoded audio or speech signal 5. The decoded audio or speech signal 5 is intended to be as similar to the original audio or speech signal 3 as possible. However, the decoded audio or speech signal 5 always comprises coding noise to some extent. The receiver unit 2 further comprises a postfilter 30, which receives the decoded audio or speech signal 5 from the decoder 20, performs a postfiltering procedure and outputs a postfiltered decoded audio or speech signal 6.

The basic idea of postfilters is to shape the spectral shape of the coding noise such that it becomes less audible, which essentially exploits the properties of human sound perception. In general this is done such that the noise is moved to perceptually less sensitive frequency regions where the speech signal has relatively high power (spectral peaks) while it is removed from regions where the speech signal has low power (spectral valleys). There are two fundamental postfilter approaches, short-term and long-term postfilters, also referred to as formant and, respectively, pitch or fine-structure filters. In order to get good performance usually adaptive postfilters are used.

As mentioned above, pitch or fine-structure postfilters are useful within the present invention. The superposition of the decoded speech signal with time-shifted versions of it, results in an attenuation of uncorrelated coding noise in relation to the desired speech signal, especially in between the speech harmonics. The described effect can be obtained both with non-recursive and recursive filter structures. One such general form described in [4] is given by:

$$H(z) = \frac{1 + \alpha z^{-T}}{1 - \beta z^{-T}},$$

where T corresponds to the pitch period of the speech.

In practice non-recursive filter structures are preferred. One more recent non-recursive pitch postfilter method is described in the published US patent application 2005/0165603, which is applied in the 3GPP (3rd Generation Partnership Project) AMR-WB+ (Extended Adaptive Multi-Rate-Wideband codec) [3GPP TS 26.290] and 3GPP2 VMR-WB (Variable Rate Multi-Mode Wideband (VMR-WB) codec) [3GPP2 C.S0052-A: "Source-Controlled Variable-Rate Multimode Wideband Speech Codec (VMR-WB), Service Options 62 and 63 for Spread Spectrum Systems"] audio and speech coding standards. Here, the basic idea is firstly to calculate a coding noise estimate r(n) by means of the following relation:

$$r(n)=y(n)-y_p(n),$$

where y(n) is the decoded audio or speech signal and $y_p(n)$ is a prediction signal calculated as:

$$y_p(n)=0.5\cdot(y(n-T)+y(n+T)).$$

Secondly, a low-pass (or band-pass) filtered version of the noise estimate, weighted with some factor $\alpha$ is subtracted from the speech signal, resulting in the enhanced audio or speech signal:

$$y_{enh}(n)=y(n)-\alpha\cdot LP\{r(n)\}.$$

A suitable interpretation of the low-pass filtered noise signal, if inverted in sign, is to look at it as enhancement signal compensating for a low-frequency part of the coding noise. The factor $\alpha$ is adapted in response to the correlation of the prediction signal and the decoded speech signal, the energy of the prediction signal and some time average of the energy of difference of the speech signal and the prediction signal.

As mentioned, one problem with pitch postfilters of prior art which evaluate the above defined expression $y_p(n)=0.5\cdot(y(n-T)+y(n+T))$ is that they require one future pitch period of the decoded speech signal y(n+T), in turn adding algorithmic delay. AMR-WB+ and VMR-WB solve this problem by extending the decoded audio or speech signal into the future, based on the available decoded audio or speech signal and assuming that the audio or speech signal will periodically extend with the pitch period T. Under the assumption that the decoded audio or speech signal is available up to, exclusively, the time index $n^+$, the future pitch period is calculated according to the following expression:

$$\hat{y}(n+T)) = \begin{cases} y(n+T) & n+T < n^+ \\ y(n) & n+T \geq n^+. \end{cases}$$

As this extension is only an approximation, there is some compromise in quality compared to what could be obtained if the true future decoded speech signal was used.

Figure 2:
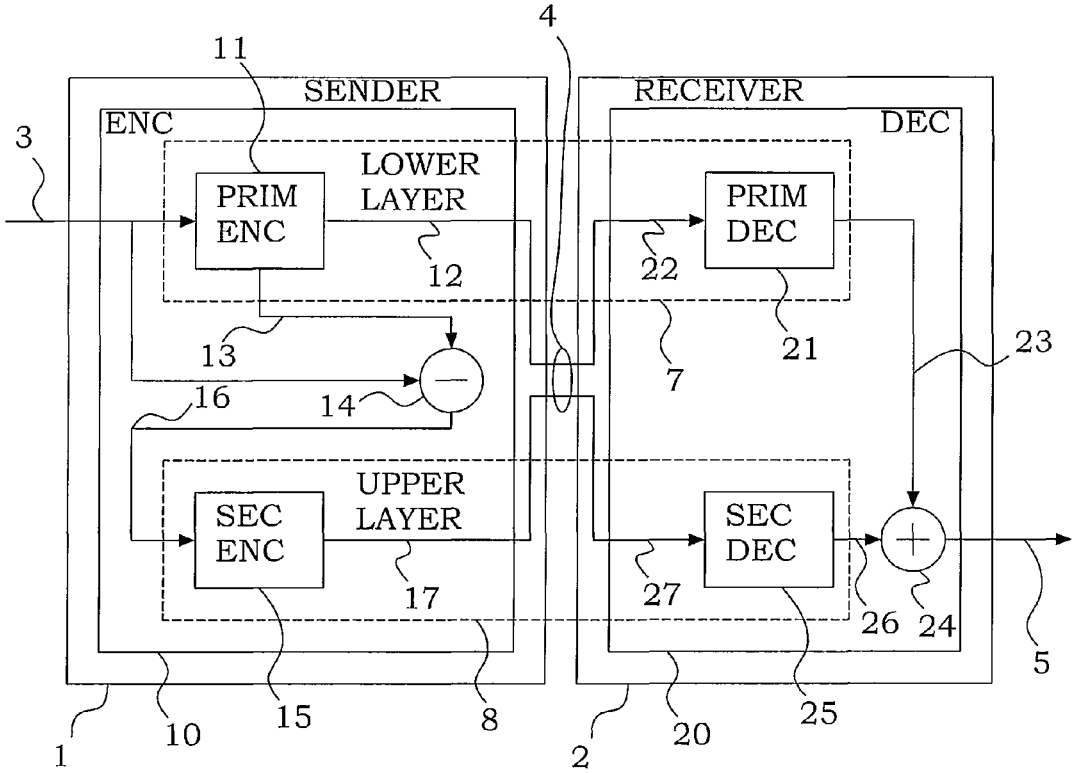
FIG. 2 is a block scheme of a general scalable audio or speech codec system.

The present invention concerns scalable audio or speech codec devices, and a short review of some systems that would be possible to use together with the basic ideas of the present invention are presented here below. FIG. 2 illustrates a block scheme of a general scalable audio or speech codec system. The sender unit 1 here comprises an encoder 10 that encodes incoming audio or speech signal 3 into a stream of parameters 4. The entire encoding takes place in two layers, a lower layer 7, in the sender comprising a primary encoder 11, and at least one upper layer 8, in the sender unit comprising a secondary encoder 15. The scalable codec device can be provided with additional layers, but a two-layer decoder system is used in the present disclosure as model system. However, the principles of the present invention can also be applied to scalable codecs with more than two layers. The primary encoder 11 receives the incoming audio or speech signal 3 and encodes it into a stream of primary parameters 12. The primary encoder does also decode the primary parameters 12 into an estimated primary signal 13, which ideally will correspond to a signal that can be obtained from the primary parameters 12 at the decoder side. The estimated primary signal 13 is compared with the original incoming audio or speech signal 3 in a comparator 14, in this case a subtraction unit. The difference signal is thus a primary coding noise signal 16 of the primary encoder 11. The primary coding noise signal 16 is provided to the secondary encoder, which encodes it into a stream of secondary parameters 17. These secondary parameters 17 can be viewed as parameters of a preferred enhancement of the signal decodable from the primary parameters 12. Together, the primary parameters 12 and the secondary parameters 17 form the general stream of parameters 4 of the incoming audio or speech signal 3.

The parameters 4 are typically encoded and transferred to a receiver unit 2. The receiver unit 2 comprises a decoder 20, which receives the parameters 4 representing the original audio or speech signal 3, and decodes these parameters 4 into a decoded audio or speech signal 5. The entire decoding takes also place in the two layers; the lower layer 7 and the upper layer 8. In the receiver unit, the lower layer 7 comprises a primary decoder 21. Analogously, the upper layer 8 comprises in the receiver unit a secondary decoder 25. The primary decoder 21 receives incoming primary parameters 22 of the stream of parameters 4. Ideally, these parameters are identical to the ones created in the encoder 10, however, transmission noise may have distorted the parameters in some cases. The primary decoder 21 decodes the incoming primary parameters 22 into a decoded primary audio or speech signal 23. The secondary decoder 25 analogously receives incoming secondary parameters 27 of the stream of parameters 4. Ideally, these parameters are identical to the ones created in the encoder 10, however, also here transmission noise may have distorted the parameters in some cases. The secondary decoder 21 decodes the incoming secondary parameters 22 into a decoded enhancement audio or speech signal 26. This decoded enhancement audio or speech signal 26 is intended to correspond as accurately as possible to the coding noise of the primary encoder 11, and thereby also similar to the coding noise resulting from the primary decoder 21. The decoded primary audio or speech signal 23 and the decoded enhancement audio or speech signal 26 are added in an adder 24, giving the final output signal 5.

If only the primary parameters 22 are received in the receiving unit 2, the receiving unit only supports primary decoding or by any reason secondary decoding is decided not to be performed, the resulting decoded enhancement audio or speech signal 26 will be equal to zero, and the output signal 5 will become identical to the decoded primary audio or speech signal 23. This illustrates the flexibility of the concept of scalable codec systems. Any postfiltering is according to prior art typically performed on the output signal 5.

The most used scalable speech compression algorithm today is the 64 kbps A/U-law logarithmic PCM codec according to ITU-T Recommendation G.711, "Pulse code modulation (PCM) of voice frequencies", November 1988. The 8 kHz sampled G.711 codec converts 12 bit or 13 bit linear PCM (Pulse-Code Modulation) samples to 8 bit logarithmic samples. The ordered bit representation of the logarithmic samples allows for stealing the Least Significant Bits (LSBs) in a G.711 bit stream, making the G.711 coder practically SNR-scalable (Signal-to-Noise Ratio) between 48, 56 and 64 kbps. This scalability property of the G.711 codec is used in the Circuit Switched Communication Networks for in-band control signaling purposes. A recent example of use of this G.711 scaling property is the 3GPP-TFO protocol (TFO=tandem-free operation according to 3GPP TS28.062) that enables Wideband Speech setup and transport over legacy 64 kbps PCM links. Eight kbps of the original 64 kbps G.711 stream is used initially to allow for a call setup of the wideband speech service without affecting the narrowband service quality considerably. After call setup the wideband speech will use 16 kbps of the 64 kbps G.711 stream. Other older speech coding standards supporting open-loop scalability are ITU-T Recommendation G.727, "5-, 4-, 3- and 2-bit/sample embedded adaptive differential pulse code modulation (ADPCM)", December 1990 and to some extent G.722 (sub-band ADPCM).

A more recent advance in scalable speech coding technology is the MPEG-4 (MPEG=Moving Picture Experts Group) standard (ISO/IEC-14496) that provides scalability extensions for MPEG-4-CELP. The MPE base layer may be enhanced by transmission of additional filter parameter information or additional innovation parameter information. The International Telecommunications Union-Standardization Sector, ITU-T has recently ended the standardization of a new scalable codec according to ITU-T Recommendation G.729.1, "G.729 based Embedded Variable bit-rate coder: An 8-32 kbit/s scalable wideband coder bitstream interoperable with G.729", May 2006, nicknamed as G.729.EV. The bit rate range of this scalable speech codec is from 8 kbps to 32 kbps. The major use case for this codec is to allow efficient sharing of a limited bandwidth resource in home or office gateways, e.g. a shared xDSL 64/128 kbps (DSL=Digital Subscriber Line, xDSL=generic term for various specific DSL methods) uplink between several VoIP (Voice over Internet Protocol) calls.

Figure 3:
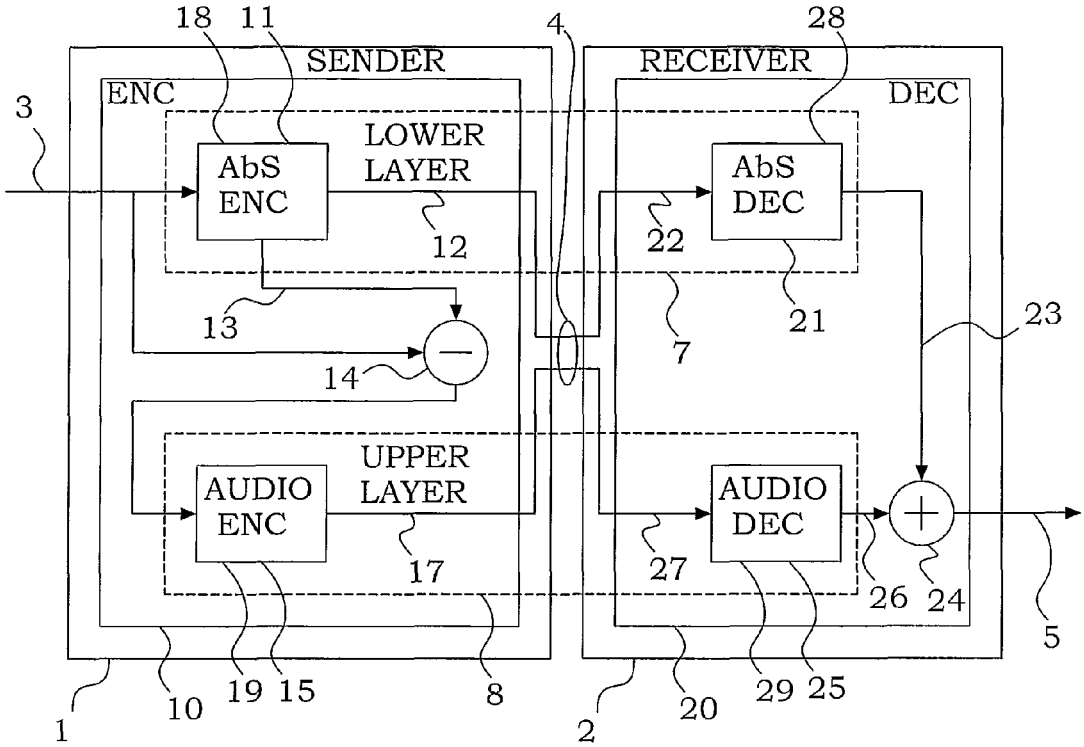
FIG. 3 is a block scheme of another scalable audio codec system where higher layers support for the coding of non-speech audio signals.

One recent trend in scalable speech coding is to provide higher layers with support for the coding of non-speech audio signals such as music. One such approach is illustrated in FIG. 3. In such codecs the lower layer 7 employs mere conventional speech coding, e.g. according to the analysis-by-synthesis (AbS) paradigm of which CELP (Code-Excited Linear Prediction) is a prominent example. In the present embodiment, the primary encoder 11 is thus a CELP encoder 18 and the primary decoder 21 is a CELP decoder 28. As such coding is very suitable for speech only but not that much for non-speech audio signals such as music, the upper layer 8 instead works according to a coding paradigm which is used in audio codecs. Therefore, in the present embodiment, the secondary encoder is an audio encoder 19 and the secondary decoder is an audio decoder 29. In the present embodiment, typically the upper layer 8 encoding works on the coding error of the lower-layer coding.

Now, the description is turning to the central parts of the present invention. The present invention relates to codecs which have structural similarities to the above described scalable speech or audio codec. A primary and a secondary decoding are utilized, and the resulting signals are combined. The typical implementation is currently believed to be a scalable speech or audio codec, in which a codec performs a primary lower-layer coding and in which a secondary upper-layer codec is used. The idea further uses the fact that the primary codec typically has lower algorithmic delay than the secondary codec, which typically is the case if e.g. the primary codec is a time-domain speech codec and if the secondary codec e.g. is a frequency domain audio codec. The two coding principles are different and give therefore rise to different kinds of coding noise. If a postfiltering is made of the decoded primary audio or speech signal, two different signals are available for enhancing the signal. The idea is then to construct the final enhancement signal, compensating for the primary coding noise, as a combination of two component enhancement signals. The first component is derived from the lower-layer primary decoded signal, enhanced by postfiltering, and the second component is derived from the upper-layer secondary decoded signal. In a particular embodiment, the postfiltering relates to pitch postfilters.

Figure 4:
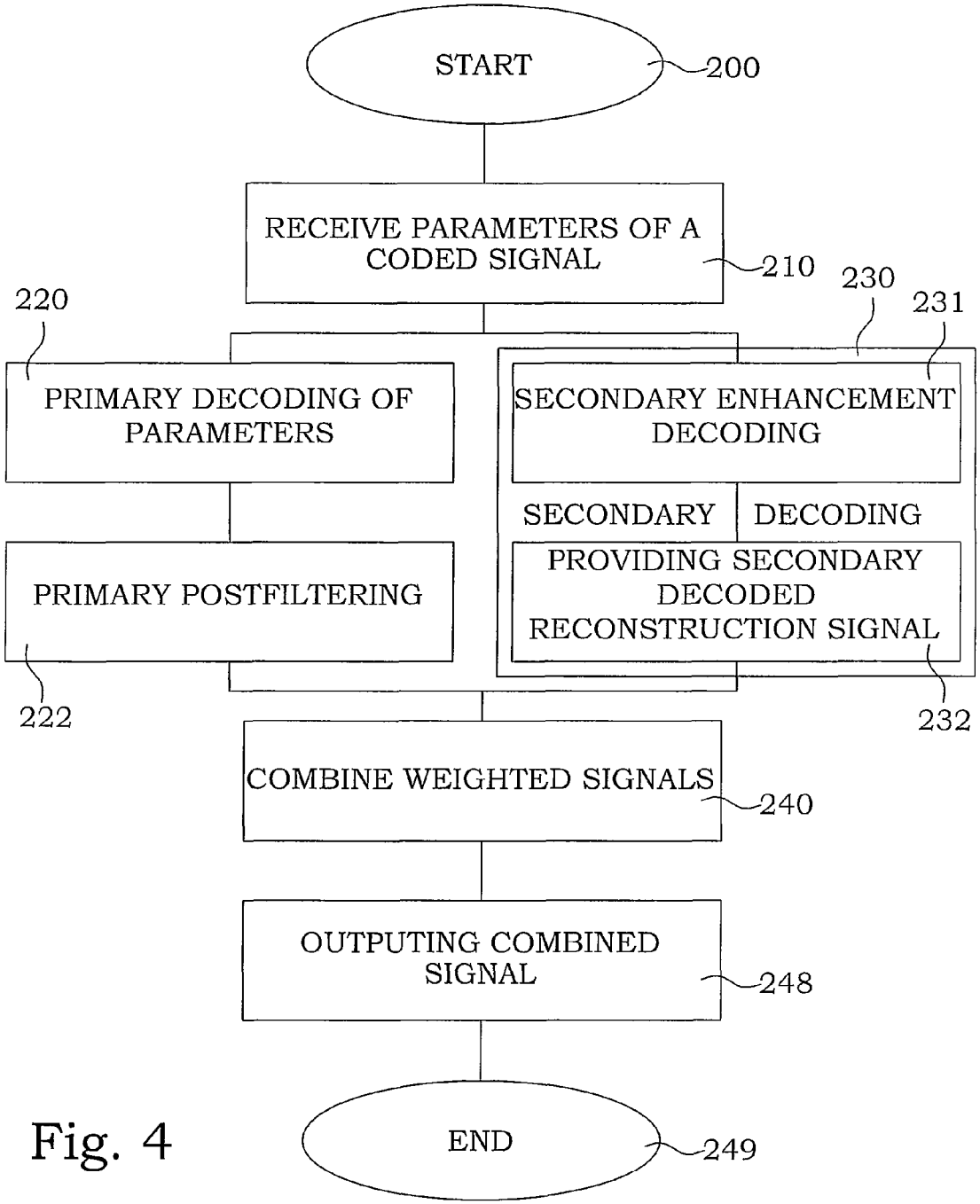
FIG. 4 illustrates a flow diagram of steps of an embodiment of a method according to the present invention.

FIG. 4 illustrates a flow diagram of steps of an embodiment of a method according to the present invention. The method of decoding coded signals representing audio begins in step 200. In step 210, parameters of a coded signal are received. A primary decoding of the parameters into a primary decoded signal is performed in step 220. In step 222 the primary decoded signal is primary postfiltered into a primary postfiltered signal. The parameters of the coded signal are also parallelly secondary decoded in step 230 into a secondary decoded signal. In the present embodiment, step 230 comprises two substeps. In step 231, the parameters of the coded signal are secondary enhancement decoded into a secondary decoded enhancement signal. In step 232 a secondary decoded reconstruction signal is provided based on the secondary decoded enhancement signal and the primary decoded signal. Typically, this is made by adding the secondary decoded enhancement signal to the primary decoded signal, if necessary delayed by an amount equal to the algorithmic delay for achieving the secondary decoded enhancement signal. Here, it is to be noted that typically the secondary enhancement signal is encoded in a weighted speech domain, which improves the perceptual properties of the coding. Essentially, by means of coding in the weighted domain the coding noise is spectrally shaped such that it becomes less audible compared to not doing such weighting. Hence, preferably, the primary signal needs also to be converted into the weighted speech domain by using the weighting operator $W^{-1}$ before the adding of the secondary decoded enhancement signal. After the adding, the sum signal is inversely weighted using the operator $W^{-1}$ yielding the unweighted secondary decoded reconstruction signal. The step of primary postfiltering preferably utilizes a difference between the delays caused by the secondary decoding and the primary decoding, respectively. In step 240 the primary postfiltered signal and a signal based on the secondary decoded signal are combined into an output signal. The signal based on the secondary decoded signal is in the present embodiment a filtered version of the secondary decoded signal. The combination is performed so that the contributions from the primary postfiltered signal and the signal based on the secondary decoded enhancement signal are weighted. Preferably, the weighting is adaptable. The combining step preferably comprises detection of signal properties whereby the adapting of the signal weights is made in response to that detected properties. Examples of such signal properties are discussed further below. The output signal is outputted in step 248. The process ends in step 249.

Since the primary decoded signal typically has lower delay than the secondary decoded signal, a decoder for both lower and upper layers needs to compensate for the delay difference in order to properly combine both signals in the decoder summation point. This can simply be done by delaying or buffering the primary decoded signal with this delay difference. According to the invention it is useful to exploit this available extra delay for high-quality postfiltering. Such utilization opens up for additional information to be utilized in the postfiltering. In the layer delay compensation buffer, more of the future of the primary decoded signal is available up to a larger time index $n^+$. As the corresponding additional time extension of the primary decoded signal can now be avoided, a postfilter for this signal can obviously do a better job in cancelling the coding noise in it.

Another particular aspect of the invention is the fact that the secondary codec operates on the actual coding error of the primary codec. Hence, the secondary codec will, depending on its bit rate and performance, compensate at least to some extent for the coding noise introduced by the primary codec. There are in other words two enhancement signals available, which both aim to improve the primary decoded audio signal. In different situations, one or the other of the enhancement signals will be better. The present invention takes advantages of that and combines the different enhancement signals and the primary decoded audio signal into a final output signal. By letting the relative amounts of the different enhancement signals that are used depend on the properties of the actual received signal, a suitable mix can be provided. In some situations, only secondary decoder enhancement will be used, in other situations, only postfiltered primary decoded signal will be used and in further other situations, there will be a mix between them.

Figure 5:
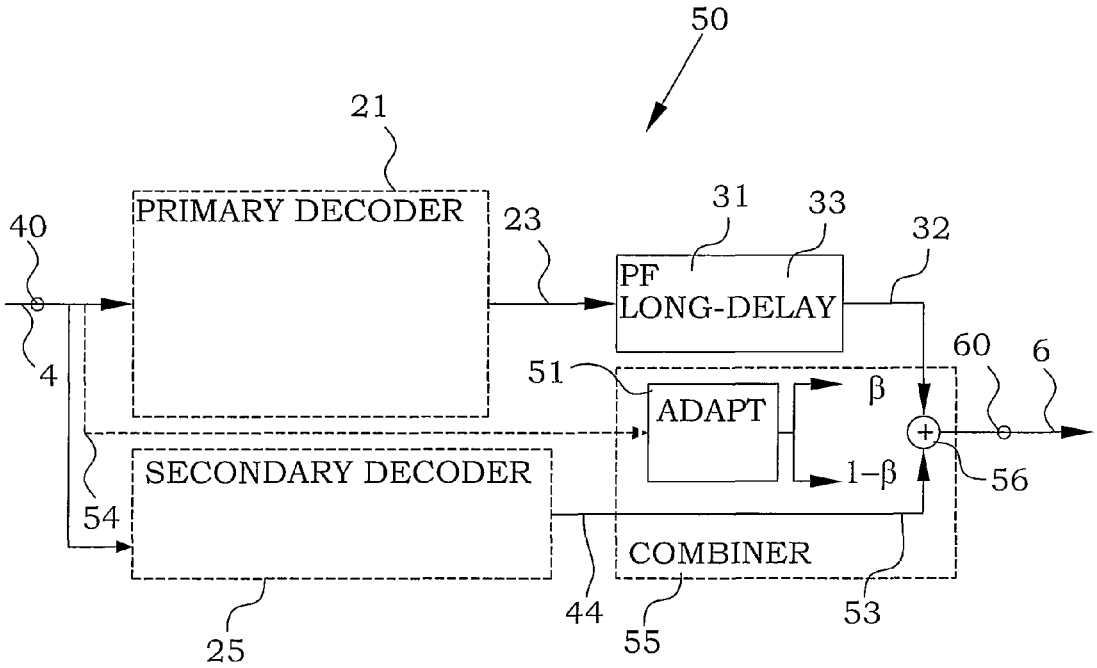
FIG. 5 illustrates a block scheme of an embodiment of a decoder device according to the present invention.

FIG. 5 illustrates a block scheme of an embodiment of decoder device 50 according to the present invention. The decoder device 50 for signals representing audio or speech comprises an input 40 for parameters 4 of coded signals. A primary decoder 21 is connected to the input 40. The primary decoder 21 is arranged to provide a primary decoded signal 23 based on the parameters 4. A primary postfilter 31 is connected to the output of the primary decoder 21 and receives the primary decoded signal 23. The primary postfilter 31 is in this embodiment a long-delay postfilter 33, utilizing a difference between delays caused by a secondary decoder 25 and the primary decoder 21, respectively, enabling to utilize "future" information for postfiltering purposes. The primary postfilter 31 provides thereby a primary postfiltered signal 32.

As mentioned above, the decoder device 50 comprises a secondary decoder 25, which is connected to the input 40. The secondary decoder 25 is arranged to provide a secondary decoded signal 44 based on the parameters 4. In this embodiment the secondary decoded signal is also a secondary decoded reconstruction signal.

The decoder device 50 further comprises a combiner arrangement 55, arranged for combining the primary postfiltered signal 32 and a signal 53 based on the secondary decoded signal 44 into an output signal 6, which is outputted via an output 60. In the present embodiment, the signal 53 based on the secondary decoded signal 44 is the secondary decoded signal 44 itself. The combiner arrangement 55 comprises an adaptive adder 56 which adds the primary postfiltered signal 32 and the secondary decoded signal 44 with a respective weight β and (1-β) for the contributions from the primary postfiltered signal 32 and the secondary decoded signal 44, respectively.

The present embodiment shows a simple way to make this combination by using one single factor β and to construct the total decoder output as 3 times the primary postfiltered signal plus (1−β) times the secondary decoded signal. This way it is guaranteed that the power of the total reconstructed signal is unaffected of the weighting factor. The weighting is in the present embodiment controlled by an adaptation control 51 which controls the magnitude of the factor β. The factor β can be controlled by the adaptation control 51 to assume values in the interval $0 \leq \beta \leq 1$. The combiner arrangement 55 comprises means 54 for detecting signal properties. In this embodiment, the signal properties are properties of a bit stream comprising the parameters 4. The adaptation control 51 selects the value of the factor β in response to the detected signal properties. The adaptive adder 56 can thereby adapting the weights, i.e. the factor β based on the detected properties, and thereby provide a suitable mix between the two enhanced signals. Such signal properties can also be e.g. the bit rate of the received bit stream and indications of lost/corrupted bits or frames. In particular, the adaptation can be made depending if the received bit stream contains any secondary coder bits at all.

Also conceivable is an adaptation in response to properties of the coded signal or the capability of the codec to encode the signal properly.

Figure 6:
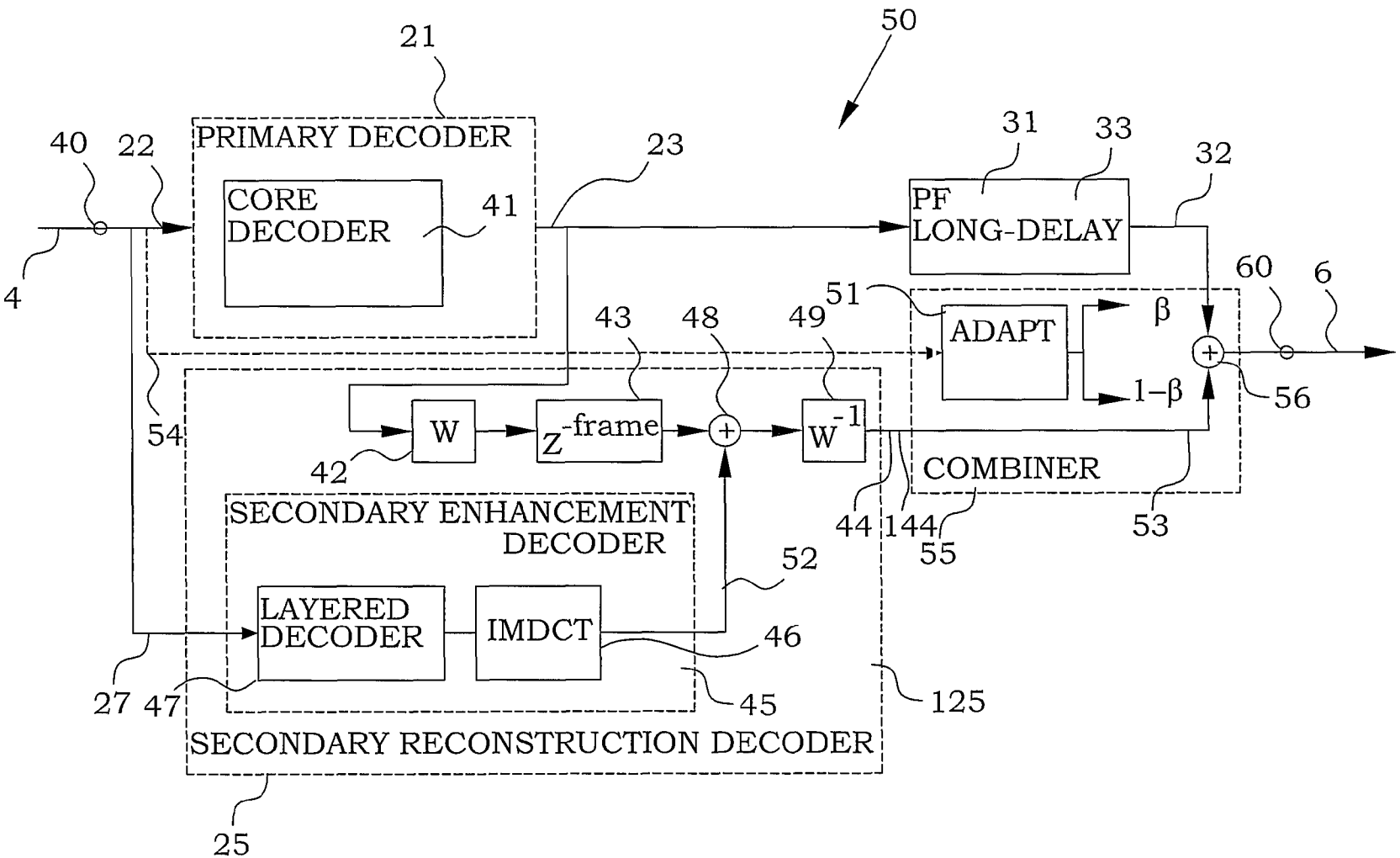
FIG. 6 illustrates a block scheme of an embodiment of a scalable decoder device according to the present invention.

FIG. 6 illustrates a block scheme of another embodiment of decoder device 50 according to the present invention. This embodiment is a scalable decoder device for signals representing audio or speech. The primary decoder 21 is also here arranged to provide a primary decoded signal 23 based on the parameters 4, and in particular based on the lower layer parameters 22. In the present embodiment, this is performed by a core decoder 41. In this particular embodiment, the core decoder 41 is actually scalable in itself with two layers. A first layer operates at rate of 8 kbps and coding up to a second layer provides a rate of 12 kbps.

The secondary decoder 25 is arranged to provide a secondary decoded signal 44 based on the parameters 4, or particularly the upper layer parameters 27 thereof. In the present embodiment, the secondary decoder 25 is a secondary reconstruction decoder 125. The secondary reconstruction decoder 125 comprises a secondary enhancement decoder 45, which is arranged to provide a secondary decoded enhancement signal 52 based on the upper layer parameters. In the present embodiment, the secondary enhancement decoder 45 in turn comprises a layered secondary decoder 47. The layered secondary decoder has one layer giving a total rate of 16 kbps, another layer 24 kbps and yet another layer 32 kbps. The secondary enhancement decoder 45 in this particular embodiment also comprises an IMDCT 46 (Inverse Modified Discrete Cosine Transform). In the present embodiment, the secondary decoder 25 is also connected to the output of the primary decoder 21 to have access to the primary decoded signal 23. The primary decoded signal 23 passes preferably a weighting filter 42, in order to transform it into the weighted speech domain in which the secondary enhancement signal can be added. As mentioned above, the secondary enhancement decoder 45 of the present embodiment decodes the secondary enhancement signal with one extra frame delay. This extra delay could be caused by the actual secondary decoder synthesis. However, the extra delay could also be caused by a higher delay during the encoding process rather than during the decoding. The primary decoded signal 23 is therefore delayed one frame in a buffer 43. The secondary decoded enhancement signal 52 and the delayed primary decoded signal are summed in an adder 48. This summed signal passes an inverse filter 49 to provide a secondary decoded signal in the form of a secondary decoded reconstruction signal 144. The secondary decoder 25 is in this embodiment in other words arranged to provide a secondary decoded signal based on the parameters 4 and the primary decoded signal 23.

It can be noted that in case the secondary enhancement decoder 45 is unable to provide decoded enhancement signal, the secondary decoded reconstruction signal 144 will be identical to the delayed primary decoded signal. In an alternative embodiment, the secondary decoded reconstruction signal 144 could instead be set to a null-signal, which in turn is suppressed by the combiner arrangement.

The scalable decoder device 50 further comprises a combiner arrangement 55 similar to what was illustrated in FIG. 5 The combiner arrangement 55 also here comprises means 54 for detecting signal properties. As above, the adaptation can be made depending if the received bit stream contains any secondary coder bits at all which in this embodiment render the secondary decoded signal different from the primary decoded signal. The combining can thereby be based on similarities between the primary decoded signal and said secondary decoded signal in a considered low-band.

Figure 7:
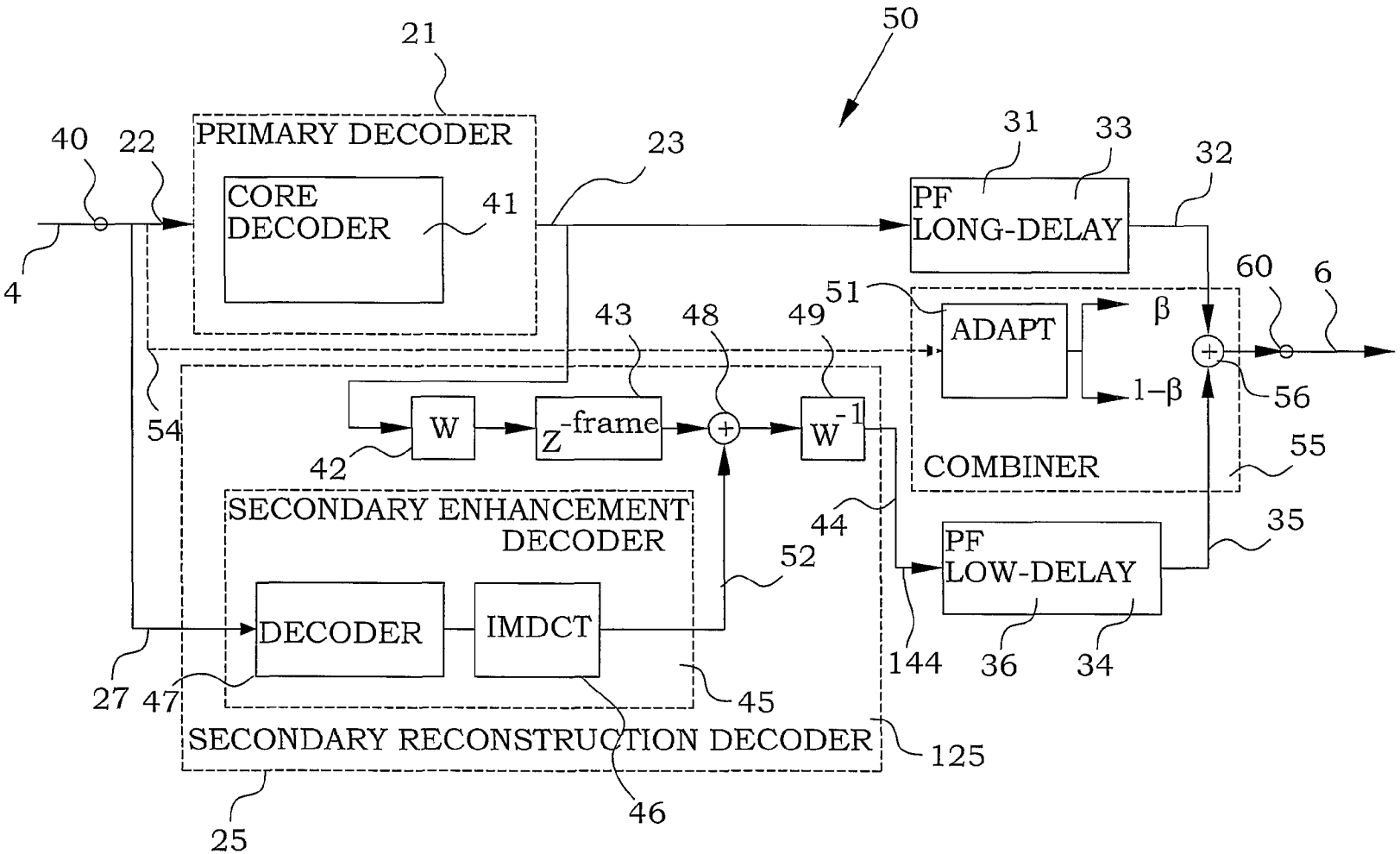
FIG. 7 illustrates a block scheme of another embodiment of a scalable decoder device according to the present invention.

In general, also the secondary decoder will leave some coding noise. FIG. 7 illustrates a block scheme of an embodiment of a scalable decoder device 50 addressing this fact. The secondary coding noise can be reduced by a secondary postfilter 34, which however now must apply time extension of the decoded signal in order not to increase the coding delay of the complete codec. The secondary postfilter 34 is connected to the output of the secondary reconstruction decoder 25 and receives the secondary decoded signal 44, in this embodiment the secondary decoded reconstruction signal 144. The secondary postfilter 34 is in this embodiment a low-delay postfilter 36 as discussed above. The secondary postfilter 34 provides thereby a secondary postfiltered signal 35. This secondary postfiltered signal 35 is then utilized as the signal 53 based on the secondary decoded signal 44 in the combiner arrangement 55.

Figure 8:
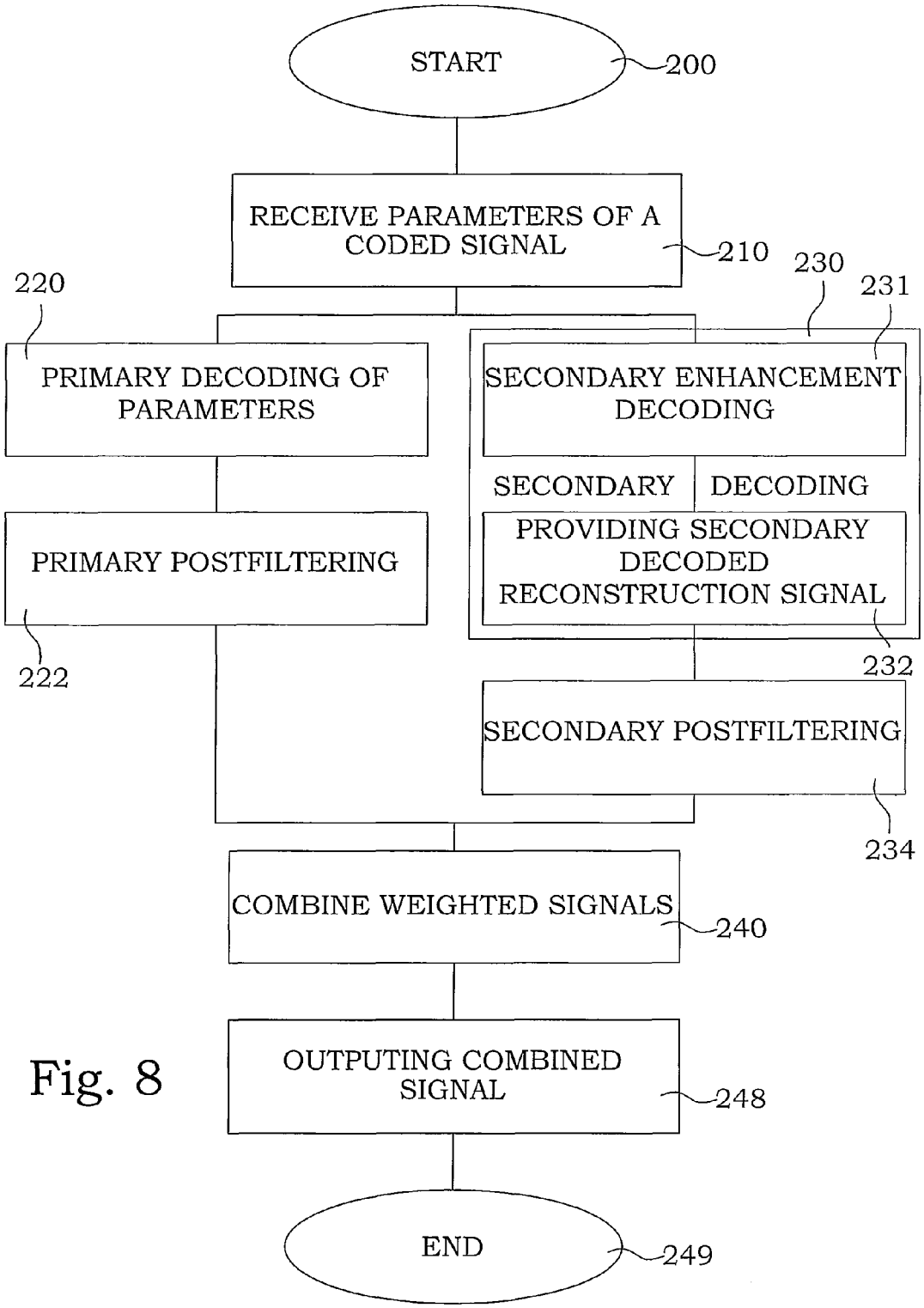
FIG. 8 illustrates a flow diagram of steps of another embodiment of a method according to the present invention.

FIG. 8 illustrates a flow diagram of an embodiment of a method used by a similar decoder arrangement. Besides the steps provided for in FIG. 4, an additional step 234 is added, in which the secondary decoded signal is secondary postfiltered into a secondary postfiltered signal, whereby the secondary postfiltered signal is used as the signal based on the secondary decoded enhancement signal.

It is now understood by anyone skilled in the art that the long-delay high-quality postfilter provided to the primary decoded signal has a good capability to compensate for coding noise. At the same time, the secondary codec preferably in combination with the low-delay postfilter also compensates for the coding noise of basically the primary encoder. Hence, the coding noise compensation capabilities of both elements are competing and it is not clear if the output of the primary decoder with high-quality postfilter or the output of the secondary decoder with low-delay postfilter provide a better total decoder output signal.

The output of the primary decoded signal with high-quality postfilter is typically preferred if the performance of the secondary coder is low. This is e.g. the case if its bit rate is low or even no secondary decoded signal is available at all. The output of the secondary decoded signal with low-delay postfilter is preferred if the secondary codec is able to compensate for almost all coding noise, which typically is the case if performance and bit rate of the secondary codec are high. The idea is hence to construct the total output of the decoder as linear combination of both signals and to make the weighting factor in this linear combination adaptive.

One further aspect of the invention is specifically related to pitch postfilters used and particularly to the scaling factor $\alpha$, which scales the coding noise estimate before it is subtracted from the decoded speech signal. As the high-quality primary postfilter estimates the coding noise more accurately it is appropriate to use a stronger factor $\alpha$ in it that in the secondary postfilter which performs a less accurate coding noise estimate.

Figure 9:
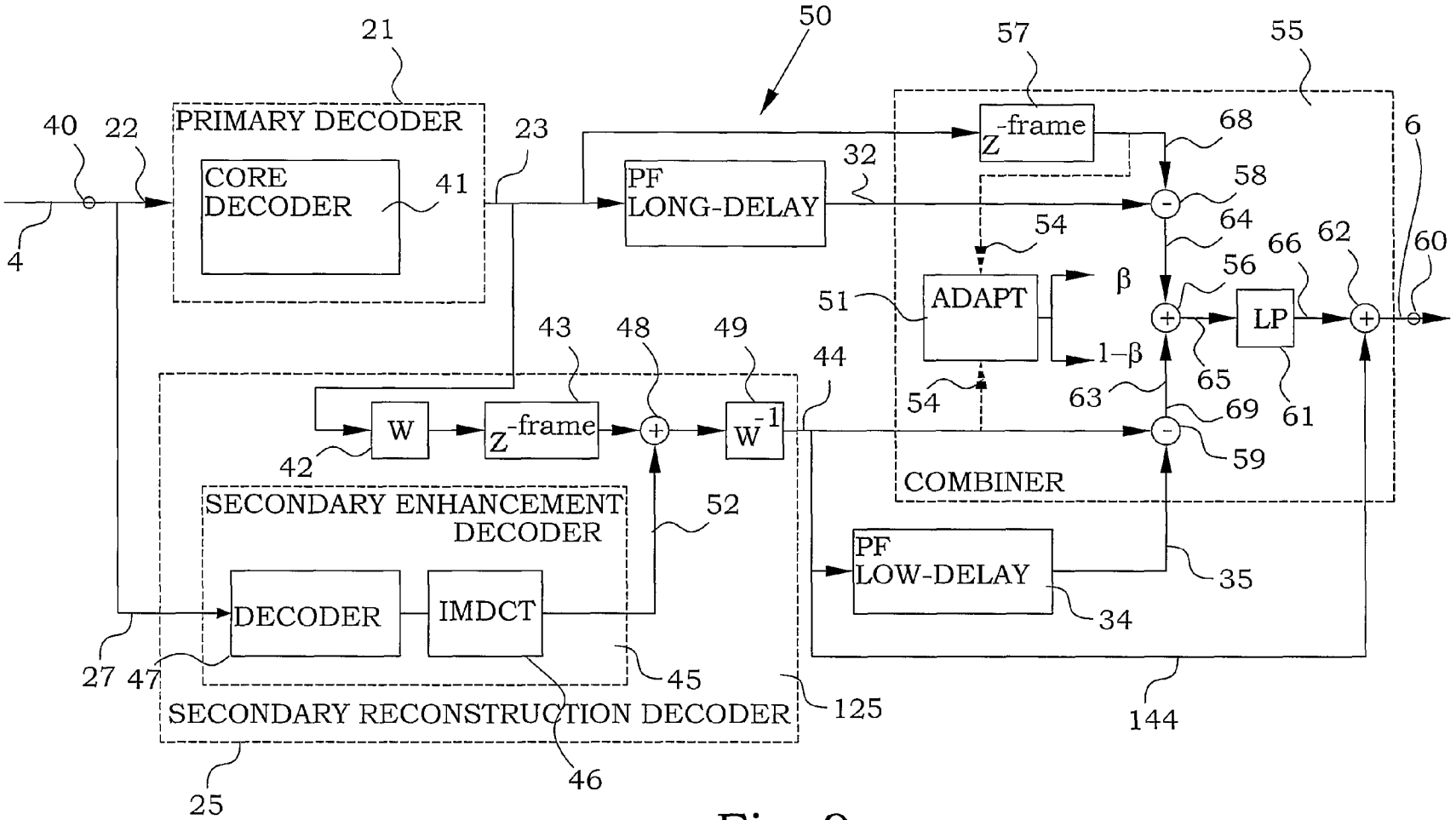
FIG. 9 illustrates a block scheme of another embodiment of a scalable decoder device according to the present invention.

Another embodiment of a scalable decoder device 50 according to the present invention is illustrated in FIG. 9. Here, a combined enhancement signal 65 for the total decoder output signal is calculated based on a primary postfilter enhancement signal 64 and an enhancement signal based on a secondary enhancement signal 69, in this embodiment a secondary postfilter enhancement signal 63. The combiner arrangement 55 thus comprises means for extracting the primary postfilter enhancement signal 64. To that end the primary decoded signal 23 is delayed in a buffer 57, for a time corresponding to the algorithmic delay of the primary postfilter 31. The primary postfilter enhancement signal 64 is then obtained by subtracting, in a subtractor 58, the delayed primary decoded signal from the high quality primary postfiltered signal 32.

Analogously, the secondary postfilter enhancement signal 63 is obtained, i.e. the combiner arrangement 55 also comprises means for extracting the secondary postfilter enhancement signal 63. This is performed in a subtractor 59 by subtracting the secondary decoded signal 44 from the low-delay secondary postfiltered signal 35. These two postfilter enhancement signals 63, 64 are then linearly combined, preferably by using a single control factor $\beta$, as in the embodiments above. A resulting total combined enhancement signal 65 is created.

The combined enhancement signal 65 is then preferably lowpass (or bandpass) filtered in a filter 61 into a lowpass filtered combined enhancement signal 66. The combined enhancement signal 65 or any signal based on the combined enhancement signal 65, such as the lowpass filtered combined enhancement signal 66 is then added in an adder 62 to a signal based on the primary decoded signal, to provide the output signal 6. In this embodiment, the signal based on the primary decoded signal is the secondary decoded reconstruction signal 144. This finally results in an enhanced total decoder output signal 6. The advantage of this embodiment compared to previous embodiments is that a possible lowpass (or bandpass) filtering in both two postfilters can be avoided, which reduces the numerical complexity and numerical precision.

In this embodiment the linear combination factor $\beta$ of the primary and the secondary postfilter signals is adapted based on the degree of similarity of the primary and the secondary decoded signals in the relevant low-frequency band of the considered postfilters. The means 54 for detecting properties of the received signal is thus in this embodiment arranged for detecting properties of the delayed primary 68 and the secondary 44 decoded signals. If these signals are very similar factor $\beta$ gets a high value (close to one), which means that the output of the primary high quality postfilter enhancement signal is preferred. This is an appropriate adaptation since similarity of the primary and secondary decoded signals in the considered lowband means that the effect of the secondary codec in that band is low and hence the coding noise cancellation effect of the high quality postfilter is preferable.

Figure 10:
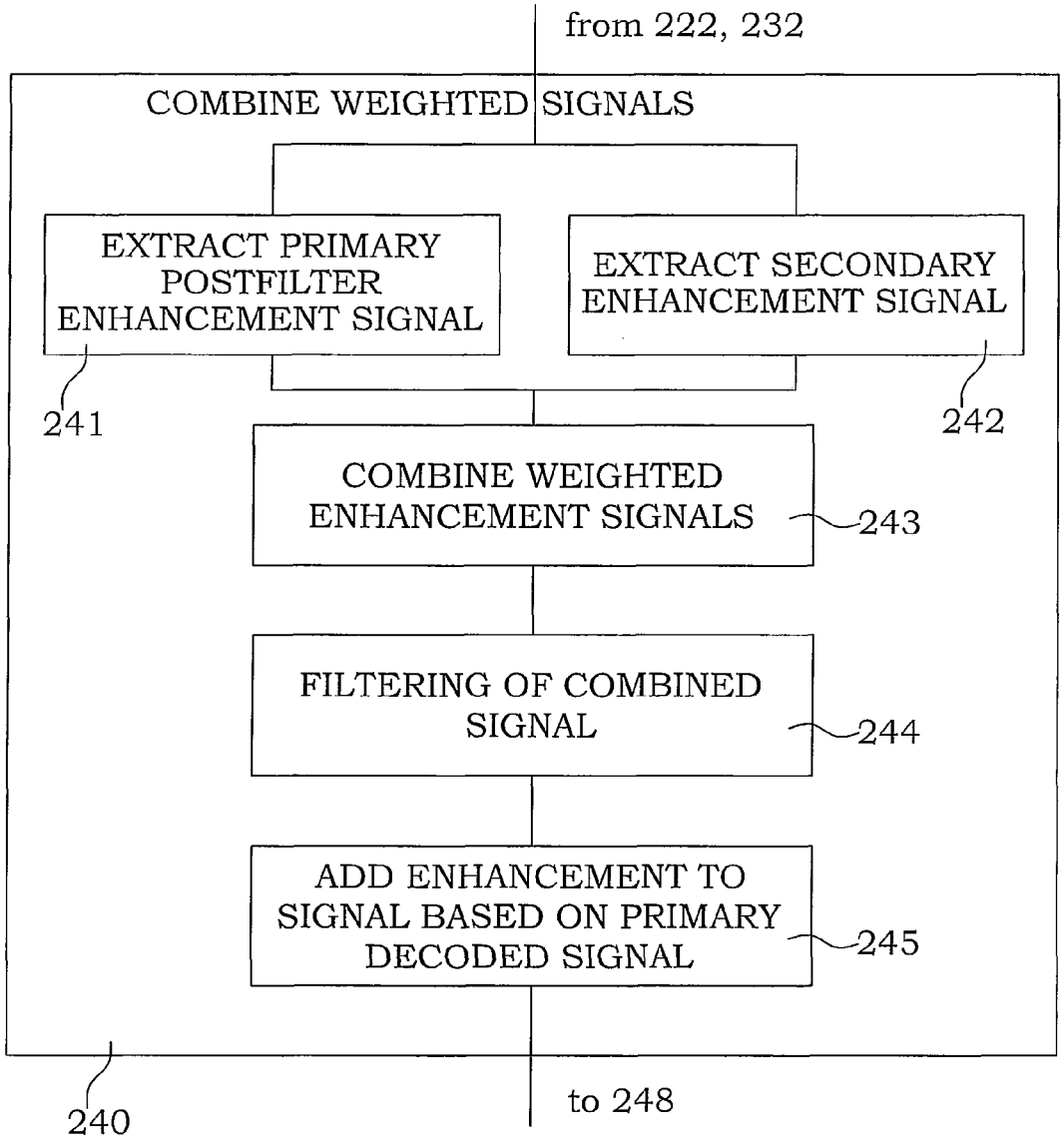
FIG. 10 illustrates a flow diagram of part steps of a particular embodiment of a method according to FIG. 7.

FIG. 10 illustrates a flow diagram of part steps of a corresponding combining step of an embodiment of a method according to the present invention. This combining step 240 is intended to be used when a second decoded signal and a postfiltering of this signal is available. The combining step 240 comprises, in step 241, extracting of a primary postfilter enhancement signal. In step 242, an enhancement signal based on the secondary decoded signal is extracted, in the present embodiment a secondary postfilter enhancement signal. In step 243, the primary postfilter enhancement signal and the enhancement signal based on the secondary decoded signal are combined into a combined enhancement signal. The combining is made with a weighting of the contributing signals, in analogy with earlier embodiments. In step 244, the combined enhancement signal is low-pass filtered into a signal based on the combined enhancement signal. Alternatively, the combined enhancement signal can be band-passed filtered, or the step could be omitted. Finally, in step 245, the signal based on said combined enhancement signal, i.e. in the present embodiment the lowpass filtered combined enhancement signal is added to a signal based on the primary decoded signal to provide the output signal. In the present embodiment, the signal based on the primary decoded signal is the secondary decoded signal.

Figure 11:
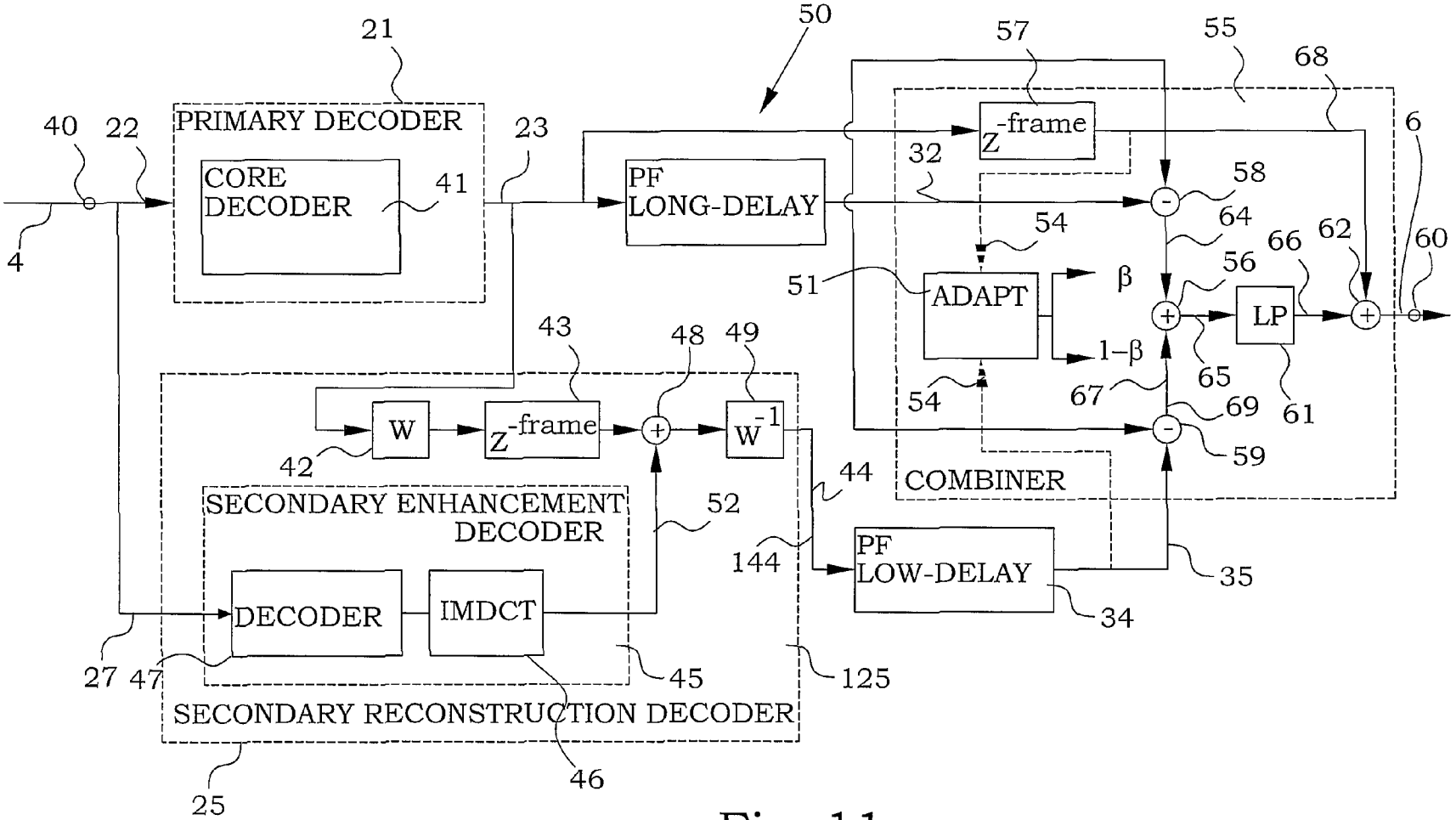
FIG. 11 illustrates a block scheme of another embodiment of a scalable decoder device according to the present invention.

Another embodiment of a scalable decoder device 50 according to the present invention is illustrated in FIG. 11. This somewhat resembles the embodiment of FIG. 9 and only the differences will be discussed here. In this embodiment, the signal based on said secondary decoded enhancement signal 69 is extracted as a difference between the secondary postfiltered signal and a delayed version 68 of the primary decoded signal, i.e. a total secondary enhancement signal 67. This total secondary enhancement signal 67 represents the combined enhancements from the secondary decoder as well as the secondary postfilter. The combined enhancement signal 65 is in this embodiment added after lowpass filtering to signal 66 to the delayed version 68 of the primary decoded signal 23. The delaying of the primary decoded signal is already available since that signal is involved in the extraction of the primary postfilter enhancement signal 64 and also the secondary postfilter enhancement signal 67.

Figure 12:
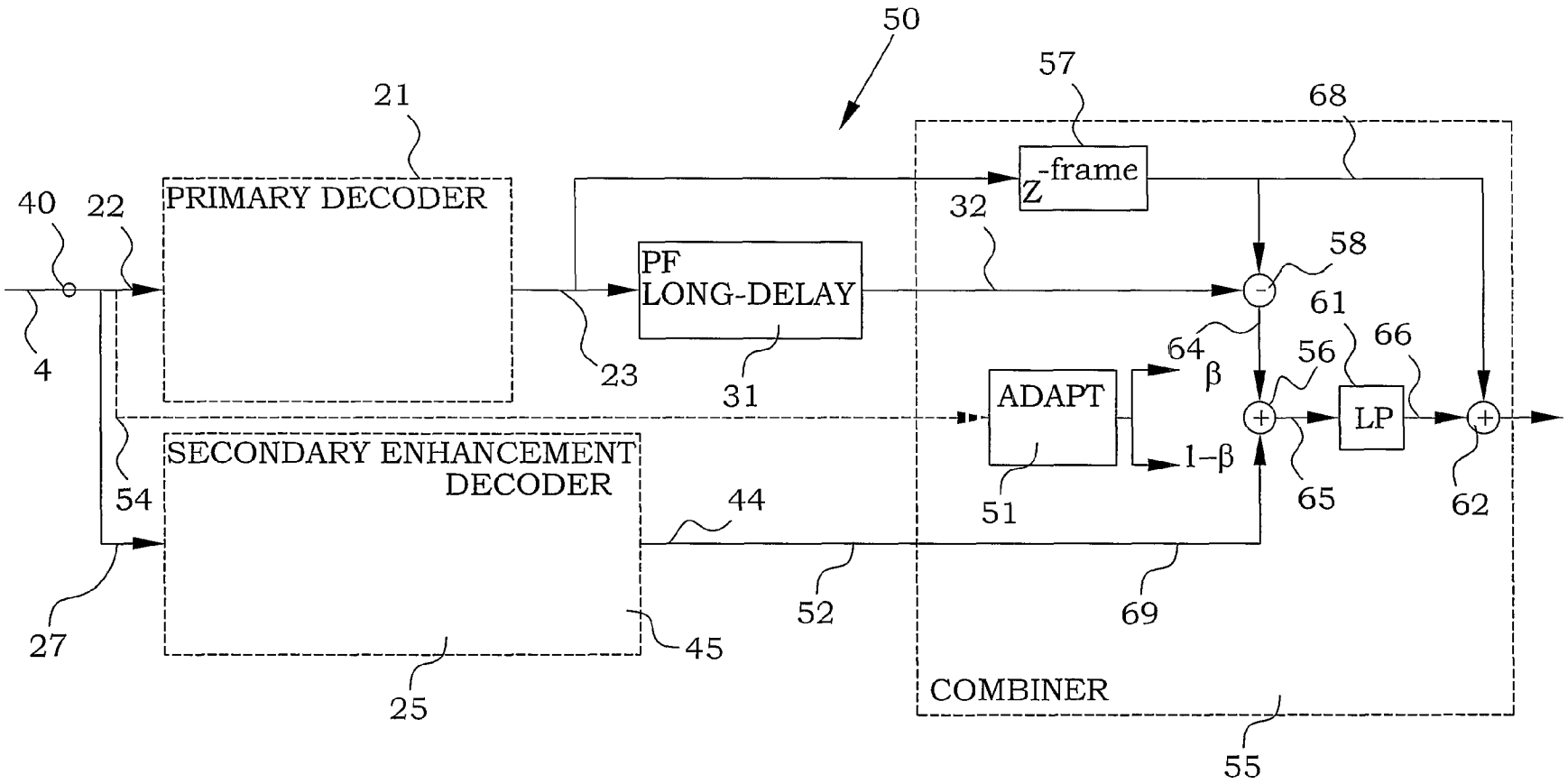
FIG. 12 illustrates a block scheme of another embodiment of a scalable decoder device according to the present invention.

In the different embodiments so far, a full decoded secondary signal is provided at some step of the procedure. However, it is also possible to use the secondary decoded enhancement signal 52 directly in the combination. Such an embodiment of a scalable decoder device 50 according to the present invention is illustrated in FIG. 12. Here, the enhancement signal based on the secondary decoded enhancement signal 69 is the secondary decoded enhancement signal 52 itself. Since there is no full secondary decoded reconstruction signal available, the signal based on the primary decoded signal is also in this embodiment the delayed version 68 of said primary decoded signal 23.

Figure 13:
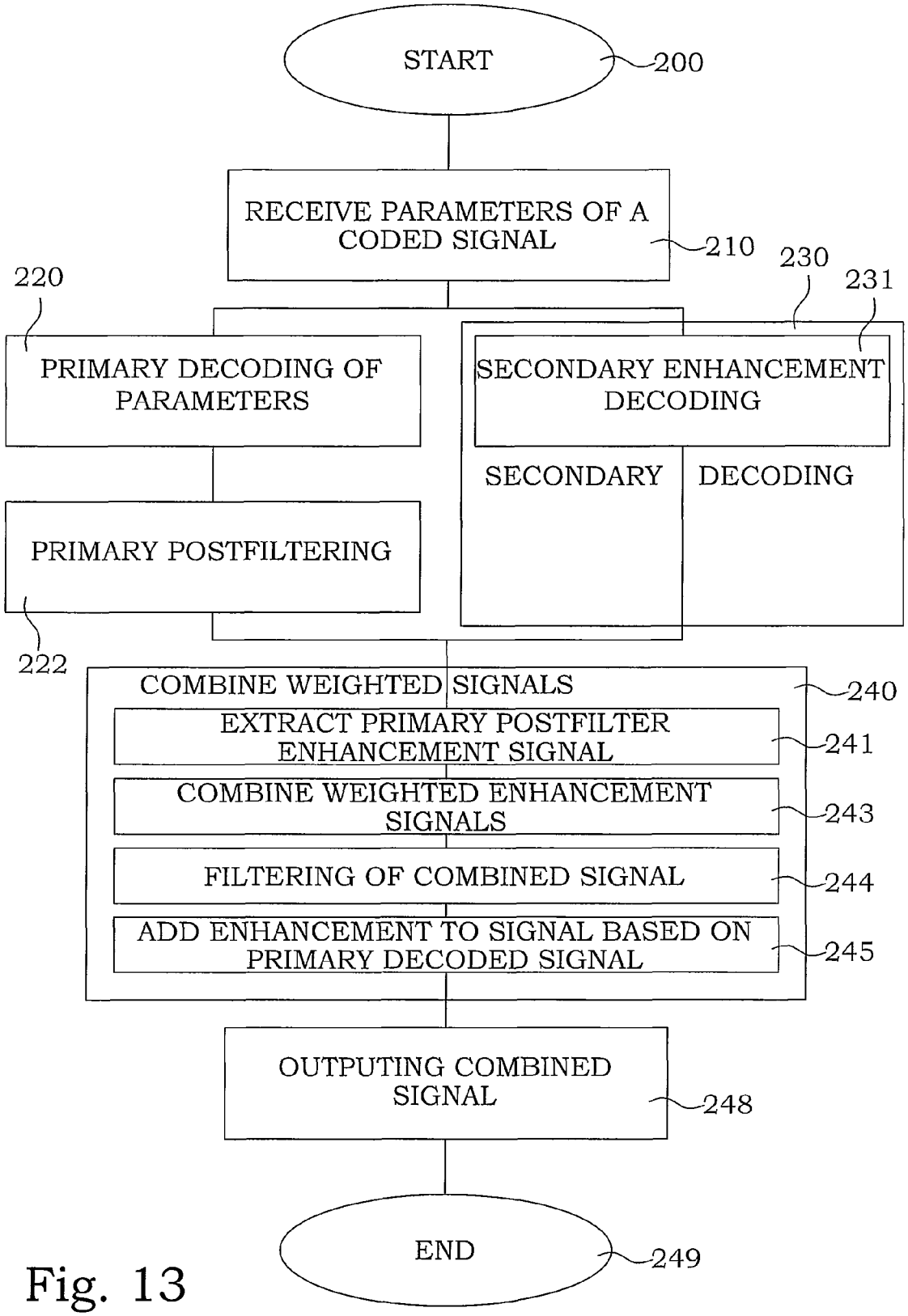
FIG. 13 illustrates a flow diagram of steps of yet another embodiment of a method according to the present invention.

FIG. 13 illustrates a corresponding flow diagram. Compared to previous flow diagrams, a number of steps are omitted. The secondary reconstruction decoding is not performed, and no secondary postfiltering. Since only the secondary decoded enhancement signal is available, also the step of extracting a suitable secondary postfilter enhancement signal can be omitted.

Figure 14:
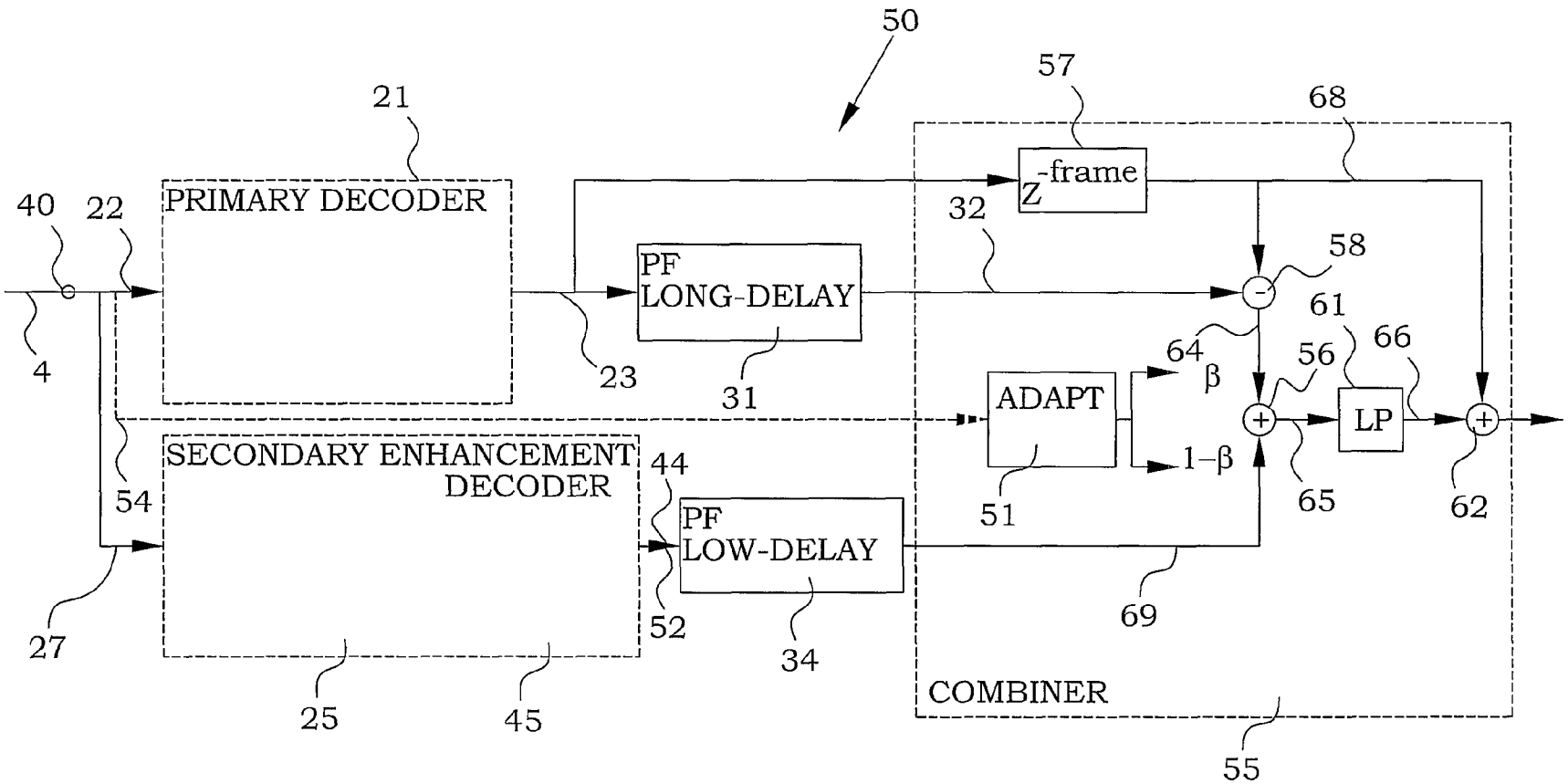
FIG. 14 illustrates a block scheme of another embodiment of a scalable decoder device according to the present invention.

An alternative embodiment to FIG. 12 is illustrated in FIG. 14. Here the secondary postfilter 34 is connected directly to an output of the secondary enhancement decoder 45, whereby the enhancement signal based on the secondary decoded enhancement signal 69 is an output signal from the secondary postfilter 64. A corresponding method follows FIG. 13, with the addition of the secondary postfiltering step.

The embodiments described above are to be understood as a few illustrative examples of the present invention. It will be understood by those skilled in the art that various modifications, combinations and changes may be made to the embodiments without departing from the scope of the present invention. In particular, different part solutions in the different embodiments can be combined in other configurations, where technically possible. The scope of the present invention is, however, defined by the appended claims.

REFERENCES

[1] P. Kroon, B. Atal, "Quantization procedures for 4.8 kbps CELP coders", in Proc IEEE ICASSP, pp. 1650-1654, 1987.

[2] V. Ramamoorthy, N. S. Jayant, "Enhancement of ADPCM speech by adaptive postfiltering", AT&T Bell Labs Tech. J., pp. 1465-1475, 1984.

[3] V. Ramamoorthy, N. S. Jayant, R. Cox, M. Sondhi, "Enhancement of ADPCM speech coding with backward-adaptive algorithms for postfiltering and noise feed-back", IEEE J. on Selected Areas in Communications, vol. SAC-6, pp. 364-382, 1988.

[4] J. H. Chen, A. Gersho, "Adaptive postfiltering for quality enhancements of coded speech", IEEE Trans. Speech Audio Process., vol. 3, no. 1, 1995.

The invention claimed is:

1. Decoder device for signals representing audio or speech, comprising:

one or more processors:

an input for receiving parameters of coded signals;

a primary decoder connected to said input, arranged, when executed by one of the processors, to provide a primary decoded signal based on said parameters;

a primary postfilter connected to an output of said primary decoder and arranged, when executed by one of the processors, to provide a primary postfiltered signal;

a secondary decoder connected to said input in addition to said primary decoder, said secondary decoder being arranged, when executed by one of the processors, to provide a secondary decoded signal based on said parameters, said secondary decoded signal being different from said primary decoded signal;

a combiner arrangement, arranged, when executed by one of the processors, for combining said primary postfiltered signal and a signal based on said secondary decoded signal into an output signal;

said output signal being a weighted combination of said primary postfiltered signal and said signal based on said secondary decoded signal; and an output for said output signal, connected to said combiner arrangement.

2. The decoder device according to claim 1, wherein said combiner arrangement is arranged, when executed by one of the processors, for adapting said weighted combination.

3. The decoder device according to claim 2, wherein said combiner arrangement is arranged, when executed by one of the processors, for detecting signal properties and wherein said adapting is performed in response to said signal properties.

4. The decoder device according to claim 3, wherein said combiner arrangement is further arranged, when executed by one of the processors, to detect similarities between said primary decoded signal and said secondary decoded signal in a considered low-band.

5. The decoder device according to claim 3, wherein said combiner arrangement is further arranged, when executed by one of the processors, to detect any availability of a partial received bit stream rendering the secondary decoded signal different from the primary decoded signal.

6. The decoder device according to claim 1, wherein said primary postfilter is a long-delay postfilter utilizing a delay difference between said primary decoded signal and said secondary decoded signal.

7. The decoder device according to claim wherein said secondary decoder is a secondary reconstruction decoder, in turn comprising a secondary enhancement decoder, and being further connected to an output of said primary decoder;

said secondary enhancement decoder being arranged, when executed by one of the processors, to provide a secondary decoded enhancement signal based on said parameters; and said secondary reconstruction decoder being arranged, when executed by one of the processors, to provide a secondary decoded reconstruction signal based on said secondary decoded enhancement signal and said primary decoded signal.

8. The decoder device according to claim 7, wherein said signal based on said secondary decoded signal is said secondary decoded reconstruction signal.

9. The decoder device according to claim 7, further comprising a secondary postfilter connected to an output of said secondary reconstruction decoder and arranged, when executed by one of the processors, to provide a secondary postfiltered signal, whereby said signal based on said secondary decoded signal is said secondary postfiltered signal.

10. The decoder device according to claim 1, wherein said combiner arrangement is further arranged, when executed by one of the processors, for extracting a primary postfilter enhancement signal, whereby said combiner arrangement is arranged, when executed by one of the processors, for combining said primary postfilter enhancement signal and an enhancement signal based on said secondary decoded signal into a combined enhancement signal;

said combined enhancement signal being a weighted combination of said primary postfilter enhancement signal and said enhancement signal based on said secondary decoded signal, and said combiner arrangement further arranged, when executed by one of the processors, for adding a signal based on said combined enhancement signal to a signal based on said primary decoded signal, to provide said output signal.

11. The decoder device according to claim 10, wherein said combiner arrangement further comprises one of a low-pass filter and a band-pass filter, filtering said combined enhancement signal into a filtered signal, being used as said signal based on said combined enhancement signal.

12. The decoder device according to claim 10, wherein said secondary decoder is a secondary enhancement decoder;

said secondary enhancement decoder being arranged, when executed by one of the processors, to provide a secondary decoded enhancement signal based on said parameters.

13. The decoder device according to claim 12, wherein said enhancement signal based on said secondary decoded signal is said secondary decoded enhancement signal, and said signal based on said primary decoded signal is a delayed version of said primary decoded signal.

14. The decoder device according to claim 12, further comprising a secondary postfilter connected to an output of said secondary enhancement decoder, whereby said enhancement signal based on said secondary decoded signal is an output signal from said secondary postfilter, and wherein said signal based on said primary decoded signal is a delayed version of said primary decoded signal.

15. The decoder device according to claim 10, wherein said secondary decoder is a secondary reconstruction decoder, in turn comprising a secondary enhancement decoder, and being further connected to an output of said primary decoder;

said secondary enhancement decoder being arranged, when executed by one of the processors, to provide a secondary decoded enhancement signal based on said parameters;

said secondary reconstruction decoder being arranged, when executed by one of the processors, to provide a secondary decoded reconstruction signal based on said secondary decoded enhancement signal and said primary decoded signal; and a secondary postfilter connected to an output of said secondary decoder and arranged to provide a secondary postfiltered signal.

16. The decoder device according to claim 15, wherein said combiner arrangement further arranged, when executed by one of the processors, for extracting a secondary postfilter enhancement signal to be used as said enhancement signal based on said secondary decoded signal, and said signal based on said primary decoded signal is said secondary decoded reconstruction signal.

17. The decoder device according to claim 15, wherein said combiner arrangement further arranged, when executed by one of the processors, for extracting said enhancement signal based on said secondary decoded signal as a difference between said secondary postfiltered signal and a delayed version of said primary decoded signal, and said signal based on said primary decoded signal is a delayed version of said primary decoded signal.

18. The decoder device according to claim 1, wherein decoder device is a scalable decoder device.

19. A method of decoding coded signals representing audio or speech, comprising:

receiving, at an input parameters of a coded signal;

decoding, using a primary decoder, said parameters into a primary decoded signal;

postfiltering, using a primary postfilter, said primary decoded signal into a primary postfiltered signal;

decoding, using a secondary decoder, said parameters into a secondary decoded signal, said secondary decoding being performed in addition to said primary decoding, said secondary decoded signal being different from said primary decoded signal;

combining said primary postfiltered signal and a signal based on said secondary decoded signal into an output signal;

said output signal being a weighted combination of said primary postfiltered signal and said signal based on said secondary decoded signal; and outputting said output signal.

20. The method according to claim 19, wherein said step of combining comprises adapting said weighted combination.

21. The method according to claim 20, wherein said step of combining comprises detecting of signal properties and wherein said adapting is performed in response to said detected signal properties.

22. The method according to claim 21, wherein said detecting comprises detecting of similarities between said primary decoded signal and said secondary decoded signal in a considered low-band.

23. The method according to claim 21, wherein said detecting comprises detecting of any availability of a partial received bit stream rendering the secondary decoded signal different from the primary decoded signal.

24. The method according to claim 19, wherein said step of postfiltering, using the primary postfilter, utilizes a delay difference between said primary decoded signal and said secondary decoded signal.

25. The method according to claim 19, wherein said step of decoding, using the secondary decoder, comprises the step of secondary enhancement decoding of said parameters into a secondary decoded enhancement signal and the step of reconstructing a secondary decoded reconstruction signal to be used as said secondary decoded signal, based on said secondary decoded enhancement signal and said primary decoded signal.

26. The method according to claim 25, wherein said signal based on said secondary decoded signal is said secondary decoded reconstruction signal.

27. The method according to claim 25, comprising the further step of postfiltering, using the secondary postfilter, said secondary decoded reconstruction signal into a secondary postfiltered signal, whereby said secondary postfiltered signal is used as said signal based on said secondary decoded signal.

28. The method according to claim 19, wherein said step of combining comprises:

extracting a primary postfilter enhancement signal;

combining said primary postfilter enhancement signal and an enhancement signal based on said secondary decoded signal into a combined enhancement signal;

said combined enhancement signal being a weighted combination of said primary postfilter enhancement signal and said enhancement signal based on said secondary decoded signal; and adding a signal based on said combined enhancement signal to a signal based on said primary decoded signal, to provide said output signal.

29. The method according to claim 28, wherein said step of combining further comprises at least one of low-pass filtering and a band-pass filtering of said combined enhancement signal into a filtered signal to be used as said signal based on said combined enhancement signal.

30. The method according to claim 28, wherein said step of decoding, using the secondary decoder, comprises the step of secondary enhancement decoding of said parameters into a secondary decoded enhancement signal to be used as said secondary decoded signal.

31. The method according to claim 30, comprising the further step of delaying said primary decoded signal;

whereby said secondary decoded enhancement signal is used as said enhancement signal based on said secondary decoded signal, and said delayed version of said primary decoded signal is used as said signal based on said primary decoded signal.

32. The method according to claim 30, comprising the further steps of:

delaying said primary decoded signal; and postfiltering, using a secondary postfilter, said secondary decoded enhancement signal into a secondary postfiltered enhancement signal;

whereby said secondary postfiltered enhancement signal is used as said enhancement signal based on said secondary decoded enhancement signal, and said delayed version of said primary decoded signal is used as said signal based on said primary decoded signal.

33. The method according to claim 28, wherein said step of decoding, using the secondary decoder, comprises the step of secondary enhancement decoding of said parameters into a secondary decoded enhancement signal and the step of reconstructing a secondary decoded reconstruction signal to be used as said secondary decoded signal, based on said secondary decoded enhancement signal and said primary decoded signal; said method comprising the further steps of:

postfiltering, using a secondary postfilter, said secondary decoded signal into a secondary postfiltered signal.

34. The method according to claim 33, wherein said step of combining comprises:

extracting of a secondary postfilter enhancement signal to be used as said enhancement signal based on said secondary decoded signal; and said secondary decoded reconstruction signal is used as said signal based on said primary decoded signal.

35. The method according to claim 33, comprising the further step of:

delaying said primary decoded signal; and wherein said step of combining comprises:

extracting said enhancement signal based on said secondary decoded signal as a difference between said secondary postfiltered signal and said delayed version of said primary decoded signal, and whereby said delayed version of said primary decoded signal is used as said signal based on said primary decoded signal.

36. The method according to claim 19, wherein said parameters are scalable encoder parameters.

* * * * *